US005129226A

United States Patent [19]

Bigelow et al.

[11] Patent Number: 5,129,226

[45] Date of Patent: Jul. 14, 1992

[54] FLAMEHOLDER FOR GAS TURBINE ENGINE AFTERBURNER

[75] Inventors: Elwin C. Bigelow, Scotia; Anil Gulati, Schenectady, both of N.Y.

[73] Assignee: General Electric Company, Schenectady, N.Y.

[21] Appl. No.: 606,247

[22] Filed: Oct. 31, 1990

Related U.S. Application Data

[63] Continuation of Ser. No. 329,048, Mar. 27, 1989, abandoned.

[51] Int. Cl.[5] ..... F02K 3/10

[52] U.S. Cl. ..... 60/261; 60/749

[58] Field of Search ..... 60/261, 749, 725, 241, 60/737, 738; 181/213

[56] References Cited

U.S. PATENT DOCUMENTS

| | | | |
|---|---|---|---|
| 2,714,287 | 8/1955 | Carn | 60/261 |
| 2,919,550 | 1/1960 | Kaskan et al. | 60/749 |
| 3,041,836 | 7/1962 | Truman et al. | 60/261 |
| 4,445,339 | 5/1984 | Davis, Jr. et al. | 60/749 |
| 4,686,826 | 8/1987 | Koshoffer et al. | 60/261 |

OTHER PUBLICATIONS

Oates, Gordon C. "The Aerodynamics of Aircraft Gas Turbine Engines" AFAPL-TR-78-52.

"The Aerothermodynamics of Aircraft Gas Turbine Engines" by Gordon C. Oates, report AFAPL-TR-7-8-52, Wright-Patterson Air Force Base, Ohio, chapter 21, Afterburners by E. E. Zukoski, California Institute of Technology.

*Primary Examiner*—Richard A. Bertsch
*Assistant Examiner*—Timothy S. Thorpe
*Attorney, Agent, or Firm*—Patrick R. Scanlon; James C. Davis, Jr.; Paul R. Webb, II

[57] ABSTRACT

A V-shaped afterburner flameholder for a gas turbine engine has a plurality of rectangular tabs coextensive with and lying in the planes of the flameholder sidewalls. The tabs on opposing sidewalls alternate so as to introduce streamwise and spanwise (transverse) vortices in the flowing gas. The resultant streamwise vortices tend to reduce resonating vortex oscillations (screech) and the need for an acoustic liner to suppress such screech.

7 Claims, 2 Drawing Sheets

FLAMEHOLDER FOR GAS TURBINE ENGINE AFTERBURNER

This application is a continuation of application Ser. No. 07/329,048, filed Mar. 27, 1989 now abandoned.

This invention relates to flame holders for use in gas turbine engine afterburners.

In military aircraft engines operating with afterburners (to enhance thrust) under some conditions the unsteady heat release couples with the acoustic pressure fluctuations and results in large unsteady pressure oscillations termed screech. Screech if not suppressed can result in instantaneous disintegration of the afterburner hardware such as flameholder, fuel injector, liner and so on. Conventional acoustic liners are used to suppress screech. The liner has small holes which act as helmholz resonators and absorb the energy of the unsteady pressure fluctuations. This method suffers from a number of drawbacks: (1) It is costly since the pattern of holes in the liner and their size determine the modes and frequencies of the oscillations absorbed effectively by the liner, and these modes and frequencies cannot be predicted beforehand for a new configuration; (2) the liner has to be cooled and thus degrades the performance of the afterburner and the efficiency of the engine; and (3) the liner is ineffective at low frequencies.

Current afterburners use one or more concentric annular rings of V-shaped members, sometimes referred to as gutters or flameholders, as flame stabilizers. The flameholders are about 1½"-2" wide and are about 1½"-2" deep. The enclosed half-angle of the typical flameholder is generally about 20-24 degrees. The overall blockage to gas flow in the afterburner region offered by the flameholders is approximately 25%. The fuel is sprayed upstream of the flameholder. The flame is established at the downstream lips of the flameholder and is sustained by the recirculating products in the wake of the flameholder. The combustion takes place downstream of the flameholder and is generally unsteady. Under certain conditions the unsteady heat couples with acoustic pressure fluctuations in the afterburner cavity resulting in screech. The screech is generally at frequencies at or above 500 Hz.

The present inventors recognize that the primary mechanism responsible for screech is the interaction between the vortices (spanwise), i.e., the axes of the vortices are transverse to the flow direction, shed at the lips of the flameholder. As these vortices travel downstream they entrain hot recirculating products, pair up and couple with each other. After a time delay, depending on the fuel, velocity and so on, the products burn and release heat which in turn affects the dynamic pressure field in the afterburner cavity. The resulting pressure fluctuations at the lips of the flameholder create additional vortices and the process repeats. If the frequency at which this process occurs matches an acoustic mode of the device (depending on the geometry) coupling occurs and screech develops. The vortices, however, do serve the purpose of mixing the cold reactants with the hot products and are therefore vitally important in the sustenance of the flame. The flameholders are therefore essential in the afterburner. The problem is how to alleviate screech, i.e., eliminate the need for the costly acoustic liner while at the same time reducing screech to acceptable levels.

An afterburner flameholder for a gas turbine engine of the type including a central diffuser cone, an outer shell and fuel injection means between the shell and cone which define an afterburner region comprises a V-shaped annular member adapted to be secured to the engine in the afterburner region between the shell and cone with the apex of the V facing upstream in the axial direction toward the fuel injection means and the lips downstream. A plurality of spaced vortex creating members are secured to and extend from the lips of the annular member. The vortex creating members are so arranged and dimensioned so as to create alternating axial and transverse vortices of gas flowing over the flameholder through the afterburner region. The combination of transverse and axial vortices tend to minimize screech.

In the Drawing

Figure 1:
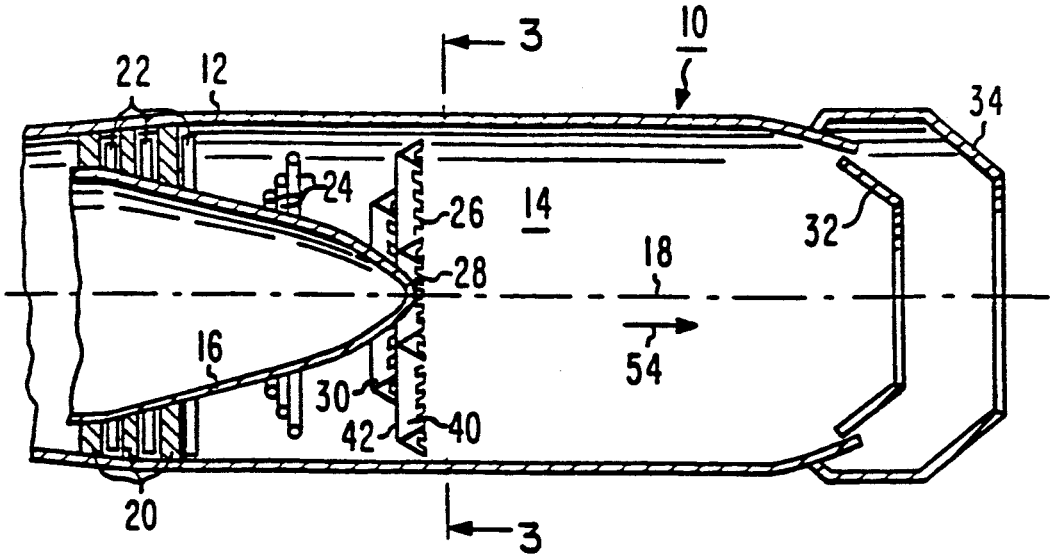
FIG. 1 is a sectional elevation view of a representative gas turbine engine including an afterburner and one embodiment of the present invention.

In FIG. 1 a gas turbine engine 10 includes an outer shell 12 enclosing an afterburner region 14. The engine 10 includes a diffuser cone 16 disposed concentrically about axis 18 of the engine. Axis 18 is centrally within the shell 12.

The engine further includes annularly disposed turbine nozzles 20 and turbine blades 22. Fuel injection rings 24 are secured downstream from the blades 22 and nozzles 20 encircling the diffuser cone 16. Three annular flameholders 26, 28 and 30 according to the present invention and of different diameters are downstream of the rings 24. Flameholder 26 is representative and will be discussed in more detail later. Flameholders 26, 28 and 30 are supported by support structures (not shown in FIG. 1). The support structures secure the outer edges of the flameholders to the shell 12. In the alternative, in other gas turbine engine implementations, the flameholders may be secured by radial V-shaped flameholders to an inner radial aligned structure. At the rear of the engine are primary and secondary annular nozzle flaps 32 and 34, respectively. Engine 10, FIG. 1, corresponds to commercially available turbo jet engines such as General Electric AJ79 engines. In the alternative, the flameholders 26, 28 and 30 corresponding to the present invention may be employed with a turbo fan engine such as a Pratt and Whitney F100 engine. Reference is made to a more detailed discussion of afterburners and aircraft gas turbine engines in a paper entitled "The Aerothermodynamics of Aircraft Gas Turbine Engines" by Gordon C. Oates, report AFAPL-TR-78-52, Wright-Patterson Air Force Base, Ohio, chapter 21, Afterburners by E. E. Zukoski, California Institute of Technology.

Figure 3:
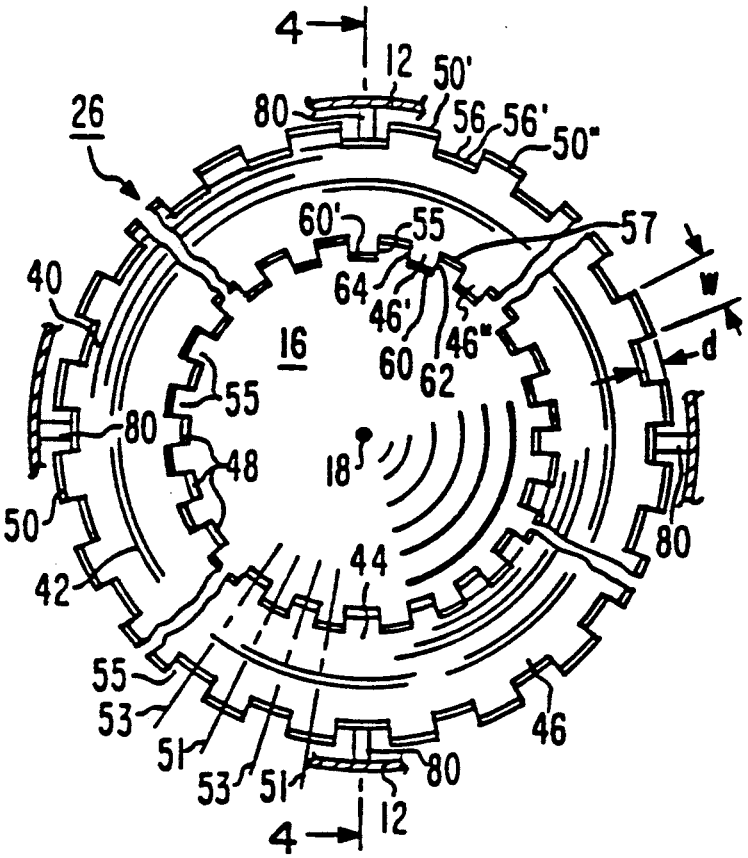
FIG. 3 is an end elevation view of a flameholder taken along lines 3—3, FIG. 1.
Figure 4:
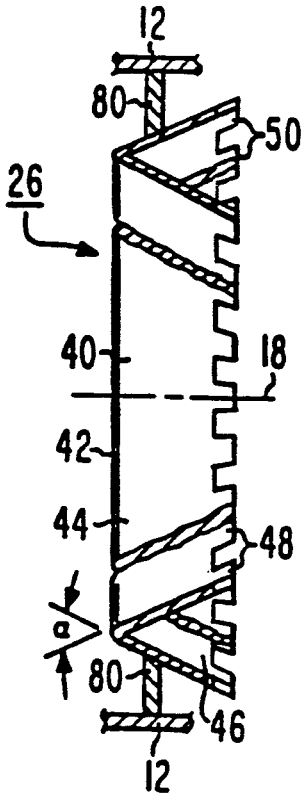
FIG. 4 is a sectional side elevation view of the flameholder of FIG. 2 taken along lines 4—4.
Figure 2:
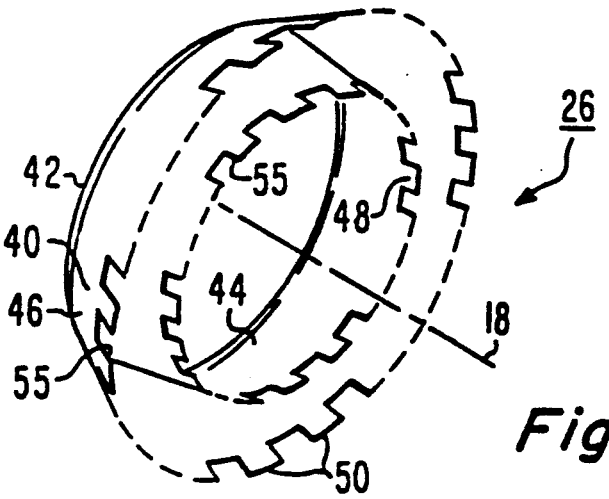
FIG. 2 is an isometric view of a flameholder employed in the embodiment of FIG. 1.

In FIGS. 2, 3 and 4, representative flameholder 26 is shown. Flameholder 26 comprises a V-shaped member 40. The member 40 has an apex 42 which faces upstream, FIG. 1, for receiving the direct flow of gases flowing through the nozzles 20, blades 22 and fuel injection rings 24. The apex 42 is concentric with axis 18. The member 40 is formed by two flared sheet material sidewalls 44 and 46, preferably sheet metal. The sidewalls 44 and 46 define an included angle $\alpha$ which may lie in a range of about 30°-50° and preferably 40°-48°. Coextensive with sidewall 44 are a plurality of tabs 48. Tabs 48 flare inwardly toward axis 18 in a continuation of the plane of sidewall 44, the tabs 48 being formed from the same sheet material as sidewall 44. A plurality of tabs 50 extend from and are coextensive with the sidewall 46. The tabs 50 flare outwardly away from axis 18 and are formed from the same sheet material as the sidewall 46. The entire structure of the flameholder 26 is formed from a single sheet material.

The tabs 48 and 50 are formed by removing rectangular openings from the sheet material in alternate regions as shown. For example, in FIG. 3, tabs 50 lie on radial lines 51 and tabs 48 lie on radial lines 53, lines 51 and 53 alternating about axis 18. The tabs have a length d which is about one half of their width w. All of the tabs 48 on one wall are identical and all of the tabs on the other wall 50 are identical. All of the openings between the respective tabs are also identically dimensioned the same as the tab dimensions for that wall. However, the tabs 50 lying on a larger diameter than tabs 48 necessarily are larger than tabs 48. The width w of the tabs relative to the length d of the tabs is important. It is believed that these dimensions may change as a function of inlet air temperature and gas velocity. There is an optimum value of the depth d relative to the width w of the tabs for optimizing the quietness of the operation. It is believed that $d=\frac{1}{2}w$ as being most effective for this purpose. However, if the blockage of the gas flow is increased beyond, for example approximately 25% of the gas flow region of the afterburner of the engine 10, FIG. 1, the flame may become unstable, oscillate in increasing intensities and possibly cause flashback.

The tabs 48 on the inner sidewall 44 of the flameholder 26 thus alternate in position with the tabs 50 on the outer sidewall 46 in the circumferential direction about axis 18. The inner and outer tabs alternate to provide a mixing of the vortices of the gases flowing through the afterburner region. This alternating arrangement of the inner and outer tabs in the axial direction of flow, for example direction 54, FIG. 1, is such that gases flow through the openings 55 in the outer sidewall 46 and mix with gases which impinge upon the aligned tab 48 of the inner sidewall 44. Conversely, a flowing gas impinging upon the tab 50" of the outer sidewall 46 produces vortices which mixes with gases which pass through an opening between adjacent tabs 46' and 46" of the inner sidewall 44. For example, in FIG. 3, assume gas is flowing through opening 56 between tabs 50' and 50". Gas also will be flowing over tab 46'. These gases will be flowing toward the reader in a direction somewhat parallel to axis 18 prior to impinging upon the surface of tab 46' and the flameholder member 40. When the gases impinge upon the tab 46', they are diverted inwardly toward axis 18. These gases tend to flow over the outer edge 60 of tab 46' and the two side edges 62 and 64. The flowing of gases over the edges 60, 62 and 64 create vortices in the region of gases flowing through the opening 56 in the same general direction as the gases flowing over edges 62 and 64.

Figure 5:
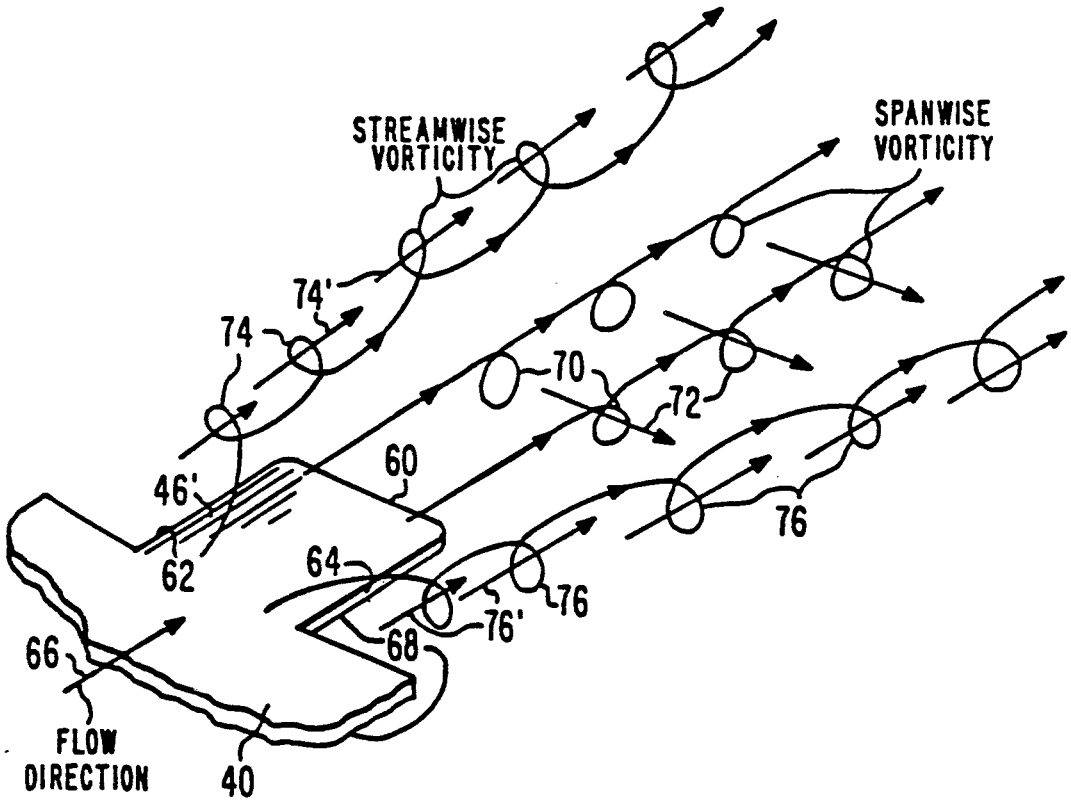
FIG. 5 is a diagram useful for explaining some of the principles of the present invention.

In FIG. 5, assume the gases are flowing in a direction 66 over member 40. The gases continue to flow over tab 46'. A low pressure is created in the interior section of member 40 in region 68. This low pressure causes the gas flow to form vortices 70 when the gas flows over the downstream edge 60 of the tab 46'. The vortices 70 have axes 72. The axes 72 are referred to as spanwise and are transverse to the flow direction 66. Gas also flows over the side edges 62 and 64 of the tab 46' creating respective vortices 74 and 76. The vortices 74 and 76 have axes 74' and 76', respectively, which are parallel generally to the flow direction 66 and are referred to as streamwise vortices.

The present inventors believe that the streamwise vortices 74 and 76 contribute to the reduction of screech of the combustion of the gases downstream the flameholder. It is believed that the primary mechanism responsible for screech is the interaction between the vortices in the spanwise direction which are shed at the lips of the prior art flameholder which have continuous circular lips. As mentioned in the introductory portion, these spanwise vortices travel downstream, entrain hot recirculating products, pair up and couple with each other unless otherwise prevented by the streamwise vortices created by the flameholder according to the present invention. After a certain time delay (depending on fuel, velocity and so forth) the hot products burn and release heat which in turn affects the dynamic pressure field in the cavity. The resulting pressure fluctuations at the lips of the flameholder lead to another set of vortices and thus the process is repeated. If the frequency at which this process occurs matches an acoustic mode of the system (depending on the geometry) coupling, unless prevented, occurs and screech develops.

The flameholder 26 combines the spanwise vortices 70 with the streamwise vortices 74 and 76. The streamwise vortices created by the edges 62 and 64 along the length of the tabs, such as tab 46', and the spanwise vortices created at the lip edges, such as edge 60, are such that the streamwise vortices are weaker in intensity than the spanwise vortices. The streamwise vortices are believed to interact with other vortices much further downstream where burning is more or less complete. Similarly, the spanwise vortices do not pair up because of the intermediate streamwise set of vortices. That is, the vortices created by the edges 60 and 60', FIG. 3, are intermediate the vortices created by edges 62 and 64 of the next adjacent tabs 46' and 48, by way of example. Further, the vortices created by the outer tabs, e.g., tabs 50' and 50" are separated by the intermediate vortices created by tab 46' and so on. The vortices from the edge 56' between tabs 50' and 50" and edge 60 of the downstream opposing tab 46' are in different planes and are spaced further apart than otherwise would occur without the presence of the tabs. Therefore, it is believed that the spanwise vortices are not sufficiently close to couple and interact while the streamwise vortices minimize the resonance of such interaction and, thus, the creation of undesirable oscillations underlying screech. Vigorous mixing, however, is obtained with the help of streamwise vortices which entrain hot products as they propagate downstream. It can be shown that the streamwise vortices increase mixing and reduce drag. It is important therefore, that an edge of a tab, such as edge 60 of tab 46', FIG. 3, oppose an edge 56' of an opening 56 between two adjacent tabs 50' and 50" adjacent to the opening on opposite sidewalls of the flameholder, e.g., sidewalls 44 and 46, respectively. These relationships are repeated throughout the flameholder.

Multiple flameholders of the type configured in FIGS. 3 and 4 may be introduced in a given afterburner in accordance with the volume of the afterburner region to be blocked. It is important that the lips of the flame holder member 40 at the edges, e.g., edges 60 and at edges of the openings, e.g., opening 57, of the tabs alternate to produce an out of phase turbulence to enhance the mixing process. By introducing both streamwise vorticity and spanwise vorticity on both sidewalls of the flameholder, sufficient turbulence is generated to provide optimum mixing of the gas flow while at the same time reducing screech caused oscillations from resonating to unacceptable levels. By precluding the buildup of acoustic oscillations of the wavefronts due by the presence of streamwise and spanwise vorticities of the gas flow, the need for an acoustic liner is alleviated.

In one embodiment, a typical flameholder may comprise an annular member having a three foot diameter, a lip separation at the outer edges of the tabs of about 1½ inches and a total lip depth of 1¾ inches to the outer edges of the tabs. The tabs have a ½ inch length d and a width w of about 1 inch. The included angle $\alpha$ of the flameholder 26 may be somewhat larger than the included angle of a typical prior art flameholder for the purpose of providing the equivalent blockage of the gas flow.

The lip edges of the tabs such as edge 60 of tab 46' are preferably normal to the sides such as edges 62 and 64. This normal relation introduces maximum differential in the direction of the edge vorticities of the flowing gas. While the edges 62 and 64 may be tapered rather than perpendicular to edge 60, the resulting vortices will tend to be less streamwise and more spanwise reducing the effectiveness of the reduction of screeching. However, it is not believed that the edges 60 and 62 may be tapered to a point because it is believed that the resulting flow would not produce the essential vortexes required for mixing.

In a wind tunnel test employing air flowing at 75 feet per second and an inlet air temperature of a maximum of 500° F. employing a flameholder constructed somewhat similarly as described above, the noise level of the resulting flameholder was reduced by a factor of about 5. (The sound pressure level was lowered by 10 dB or more at all conditions.)

In FIG. 3, a typical flameholder 26 is secured to the shell 12 by a plurality of radial extending supports 80. Supports 80 are secured to the member 40 at an outer surface of the sidewall 46. Supports 80 may comprise cylindrical rods or V-shaped gutters. In the alternative to having the flameholder 26 supported to an external annular surface such as shell 12, the flameholder may be secured to an internal structure located in the position of cone 16 in accordance with a given engine implementation.

What is claimed is:

1. A flameholder for reducing screech in gas turbine engines comprising:

an elongated V-shaped member having a pair of opposing elongated walls joined at one end and diverging to respective trailing edges, the apex of said elongated V-shaped member facing upstream; and a plurality of vortex creating members extending from each of the trailing edges in a downstream direction, each vortex creating member extending from one trailing edge aligned between vortex creating members on the opposing trailing edge so that opposing spanwise vortices originating at opposing elongated walls originate at different distances downstream from the apex of the V-shaped member and each vortex creating member can provide streamwise vortices between the spanwise vortices.

2. The flameholder of claim 1 wherein said plurality of vortex creating members comprises generally rectangular spaced apart projections on each trailing edge, with the generally rectangular projections on one trailing edge staggered relative to the generally rectangular projections on the opposing trailing edge.

3. The flameholder of claim 2 wherein said generally rectangular projections are uniformly spaced apart.

4. The flameholder of claim 3 wherein the ratio of the depth of the rectangular projection to the width of the rectangular projection is approximately 1 to 2.

5. An afterburner flameholder for a gas turbine engine, said engine including a central diffuser cone, an outer shell and fuel injection means between the shell and the cone defining an afterburner region, said flameholder comprising:

a V-shaped annular member adapted to be secured to the engine in the afterburner region between the shell and cone, said V-shaped annular member having a pair of opposing annular walls joined at one end and diverging to respective trailing edges, the apex of the V-shaped annular member facing upstream toward the fuel injection means; and a plurality of spaced apart generally rectangular projections extending from each of the trailing edges, each generally rectangular projection extending from one trailing edge aligned between rectangular projections on the opposing trailing edge so that opposing spanwise vortices originating at opposing annular walls originate at different distances downstream from the apex of the V-shaped member and each generally rectangular projection can provide streamwise vortices between the spanwise vortices.

6. The flameholder of claim 5 wherein said generally rectangular projections are uniformly spaced apart.

7. The flameholder of claim 6 wherein the ratio of the depth of the rectangular projection to the width of the rectangular projection is approximately 1 to 2.

* * * * *